United States Patent [19]

Jones et al.

[11] 4,454,997

[45] Jun. 19, 1984

[54] INLET GUIDE MEANS FOR STRAND USER DEVICES

[75] Inventors: Harold A. Jones, East Greenwich; Manuel G. Teixeira, Cumberland; Arthur N. Verrier, Warwick Neck, all of R.I.

[73] Assignee: Leesona Corporation, Warwick, R.I.

[21] Appl. No.: 354,775

[22] Filed: Mar. 4, 1982

[51] Int. Cl.[3] ..... B65H 51/20

[52] U.S. Cl. ..... 242/47.01; 139/450; 242/131

[58] Field of Search ..... 242/47.01, 47.02, 47.03, 242/47.04, 47.05, 47.06, 47.07, 47.08, 47.09, 47.1, 47.11, 47.12, 47.13, 131, 131.1, 47, 18 R, 1, 157 R, 128; 139/429, 435, 450, 452, 453

[56] References Cited

U.S. PATENT DOCUMENTS

| | | | |
|---|---|---|---|
| 2,534,339 | 12/1950 | Chaya et al. | 242/131 |
| 3,168,911 | 2/1965 | Pfarrwaller et al. | 242/131 X |
| 3,236,265 | 2/1966 | Brookshire | 242/131 X |
| 3,693,904 | 9/1972 | Bucher | 242/131 |
| 3,871,421 | 3/1975 | Pfarrwaller | 139/452 |
| 3,994,447 | 11/1976 | Sarfati et al. | 242/47.12 |
| 4,063,697 | 12/1977 | Venot | 242/131 |
| 4,234,138 | 11/1980 | Gehring et al. | 242/131.1 |
| 4,358,068 | 11/1982 | Weiss | 242/131 |

FOREIGN PATENT DOCUMENTS

| | | | |
|---|---|---|---|
| 755988 | 8/1956 | United Kingdom | 242/131 |

*Primary Examiner*—Stanley N. Gilreath
*Attorney, Agent, or Firm*—Burnett W. Norton

[57] ABSTRACT

In strand user devices such as a yarn storage feeder system of the type disclosed in U.S. Pat. No. 3,776,480 and having a yarn storage unit upon which a quantity of yarn is maintained from a yarn supply for intermittent withdrawal and delivery to yarn consuming means, a significant improvement in efficiency of the strand user device is achieved by incorporating strand guide means which are operable to control the movement of the strand, especially strand in the form of tape, from its supply source and into the user device while precluding fibrillation or splitting of the tape. Particularly in the handling of plastic tape fibrillation or splitting of the tape can occur as the tape is drawn from its supply source and guided in an angular path through a stationary member directing it to the inlet end of the storage feeder. Such fibrillation or splitting is avoided in practice with the present invention which incorporates roller means for guiding the tape to the feeder while maintaining tension into the tape at a generally uniform level both upstream and downstream of the roller means.

5 Claims, 5 Drawing Figures

FIG. 1
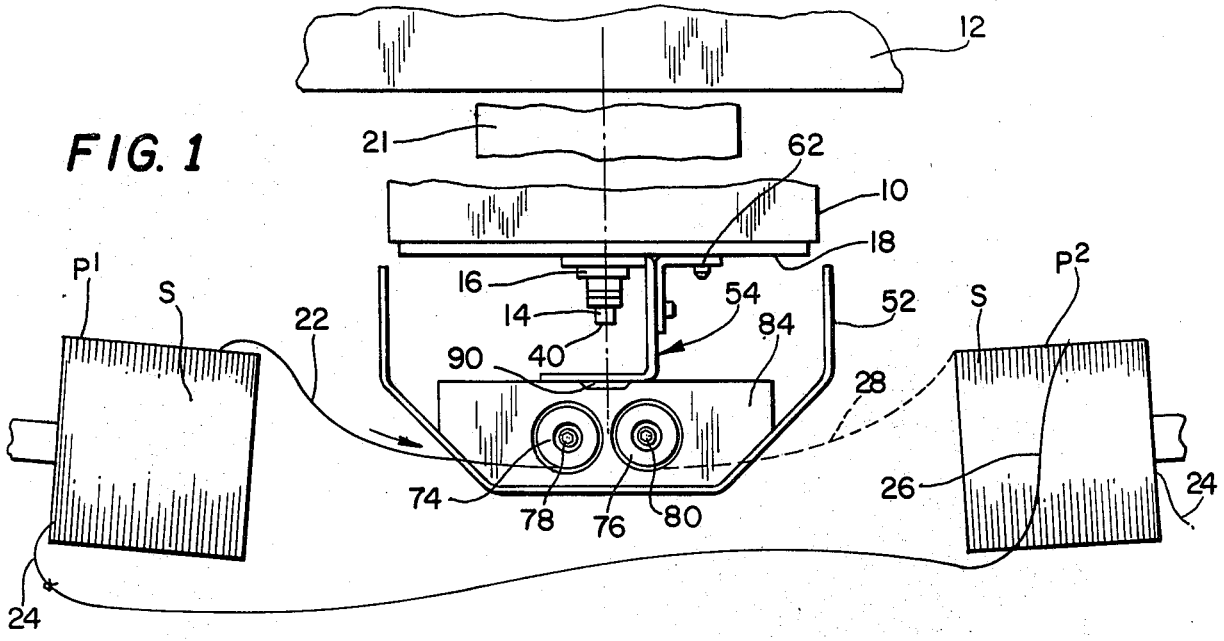
FIG. 2
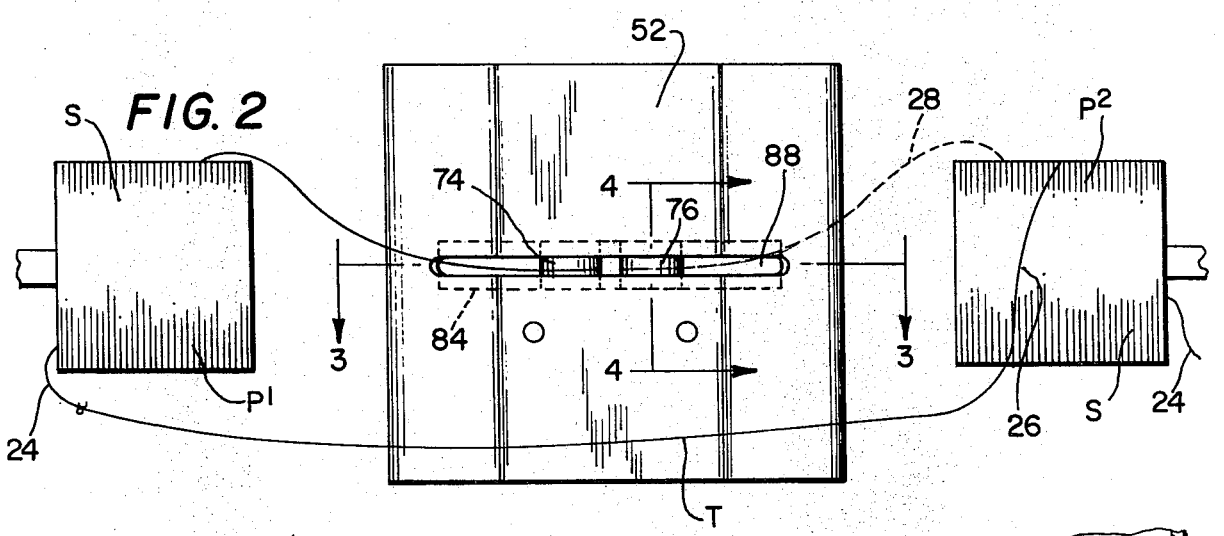
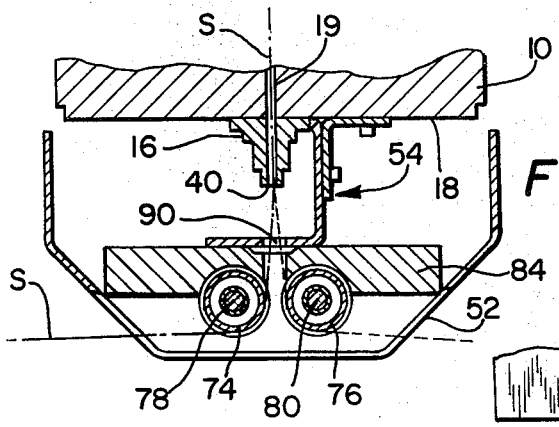
FIG. 3
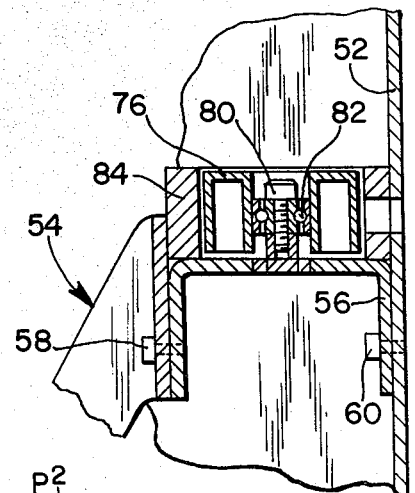
FIG. 4
FIG. 5
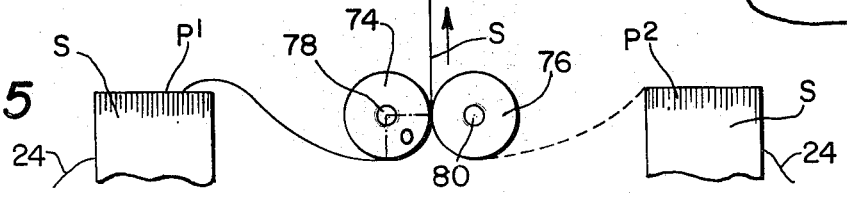

INLET GUIDE MEANS FOR STRAND USER DEVICES

BACKGROUND OF INVENTION

The present invention relates to strand user devices such as, for example, yarn storage and feeding systems adapted to collect or accumulate a given quantity of strand supplied from a strand source for delivery to an intermittently operating yarn consuming device and to replenish withdrawn yarn so as to maintain the accumulated quantity at a generally consistent level, and in the environment, represents improvements upon the yarn storage feeding system of the type disclosed in U.S. Pat. No. 3,776,480.

As is explained more fully in U.S. Pat. No. 3,776,480 it is known in the prior art to provide a yarn storage feeder system (which for ease of reference is sometimes referred to herein simply as a "feeder") interposed between a strand supply source and an intermittently operated strand consuming device such as a winder, knitting machine, weaving loom, or even another yarn storage feeder. Such feeders operate to accumulate a body of strand for ready and immediate delivery therefrom to the strand consuming device, the body of strand being replenished as lengths therefrom are withdrawn by the latter unit. Such feeders typically include a yarn collecting drum on which strand from a suitably supply source is wound temporarily and then removed under a controlled, uniform tension for passage to the consuming device. These feeders eliminate wide variations in yarn tension which occur when the strand is delivered over-end from a source, such as a cone or a package, and permits the strand to feed to the consuming unit at a substantially constant tension.

While the feeders of the type disclosed in the prior cited patent perform admirably in accumulating and delivering most types of strandular material, it has been found that when the strandular material in an anisotropic material such as polypropylene tape utilized for weaving carpet backing, the tape when advancing to and through the feeder tends to split or fibrillate, usually due to excessive tension caused by passing the tape stationary guides. Such fibrillation leads to problems in the downstream processing of the tape in the consuming device.

Amplifying on the problem just mentioned, it has been rather usual in the past to arrange a plurality of strand supply packages on stands proximate to the rear of each yarn storage feeder system, and to tie the inner strand end of an active unwinding strand package to the outer strand end of a reserve package. In the parlance of the textile trade this is often referred to as "magazining". The practice of magazining has the significant advantage that manual tending of strand supplies for the feeder is substantially lessened since several strand supply packages can be arranged at spaced positions around the inlet end of the feeder with transfer tails of adjacent packages tied together as just described so that, when an active unwinding package of strand is depleted, an adjacent reserve package automatically commences unwinding without operator attention.

In order that the strand unwinding from a supply package and being advanced to a feeder can be directed to the rotating feeder tube of the feeder without being dragged over the inlet end of the tube it is customary to provide a stationary guide coaxially aligned with the tube and slightly upstream therefrom through which the supply strand advanced. Bearing in mind that the several supply packages of strand magazined for serial delivery to the feeder system are dispersed at different loci upstream of the stationary guide due to space considerations, it follows that each strand being guided from its package follows in first path from its package to the guide, and then is wrapped about the guide to move in a second path divergent to the first path. In its second path the strand moves in a course axially with and into the feeder tube. Such wrapping of the strand about the guide increases the strand tension level downstream of the guide substantially above the tension present in the strand between the supply package and the guide since the stationary guide acts as a tension generator. The increase in tension is expressed in the well known formula:

$$T_2 = T_1 e^{\mu\theta}$$

where:

$T_2$=strand tension downstream of the guide $T_1$=strand tension upstream of the guide $\mu$=coefficient of friction of the guide $\theta$=wrap angle of the strand around the guide e=constant.

The tension is increased by other tensions introduced as the strand moves through the goose-neck strand feed tube and encounters frictional contact with the interior surfaces of the tube.

Drawing strandular materials over the surface of the stationary guides of the prior art is generally not detrimental to strands manufactured of isotropic materials. However, anisotropic products such as flat strands of polypropylene tape have been found to suffer adversely from such contact with the stationary guide, particularly in that the tape is caused to fibrillate or split. Bearing in mind that as the tape is pulled off over-end from its supply package for delivery to the feeder a single turn of twist is introduced into the tape for each wrap of tape pulled off the supply package, it follows that a stationary guide can act as a twist restrictor, precluding smooth advance of the twisted tape to the feeder. The twist in the tape is prevented from flowing over the surface of the stationary guide until an accumulation of turns of twist back up in the tape between the supply and the guide, whereupon the highly twisted tape is pulled over the surface of the stationary guide. In the course of such twist build-up the flat tape folds on itself, setting up longitudinal creases or fracture lines in the tape. Thereafter, when the tape is pulled over the stationary guide and/or when it is subjected to the additional frictional forces introduced as the tape is advanced through the feeder tube and laid on the feeder drum, it is susceptible to easy splitting along the fracture lines. Correlated with this is the unsatisfactory material woven from the tape. The woven material, rather than having weft possessing uniform turns of twist per unit length, has weft wherein the twist is accumulated in bunches along sections of the length of the strand.

In accordance with the present invention an inlet device or attachment is provided including guide rollers which are positioned to rotate with advance of the strand thereabout and guide the strand into the yarn storage feeder. The guide rolls have a point of tangency laying within the axial plane of the inlet end of the yarn storage feeder device. Accordingly, the yarn departs the roller at a tangent point from its guide roller and is fed into the feeder tube of the feeder without any substantial increase in tension over that existing between the supply package and the guide rolls. Since experimentation has shown that the principal cause of fibrillation of plastics tape being delivered in angular paths results from twist restriction in the advancing tape and tension build-up as the tape is advanced over a stationary guide, the present invention permits such anisotropic strandular material to be delivered without being split or fibrillated and with twist in the tape being distributed uniformly. Consequently, the disadvantages which has been shown to occur in practice with feeders of the prior art is avoided.

OBJECTS OF THE INVENTION

One object of the present invention is to provide guide means for controlling movement of a strand advancing in an angular path while maintaining tension in the strand substantially equal upstream and downstream of the guide means.

A further object of the present invention is to provide a yarn storage feeder system incorporating means for delivering strand material such as plastic tape thereto while precluding splitting or fibrillation of the strand in its passage to the feeder.

Another object of the present invention is to provide a yarn storage feeder system incorporating means for permitting magazining of a plurality of packages of supply strand in proximity to the inlet end of a yarn feeder so that the plurality of packages can be joined together for sequential delivery of the strand thereon to the feeder without operator attention and while preventing splitting or fibrillation of the strand material.

Other objects of the invention will in part be obvious and will in part appear hereinafter.

BRIEF DESCRIPTION OF THE DRAWINGS

FIG. 1 is a plan view of the inlet guide means of the present invention incorporated in a strand storage and feeding system and illustrating two strand supply packages magazined in proximity to the inlet end of the strand storage and feeding system for sequential delivery of the strand thereon to the feeder;

FIG. 2 is a front elevational view of the arrangement of FIG. 1;

FIG. 3 is a view taken along lines 3—3 of FIG. 2;

FIG. 4 is a view taken along lines 4—4 of FIG. 2; and

FIG. 5 is a view somewhat similar to FIG. 1 and illustrating the strand inlet guide means of the present invention operative arrayed to control weft feeding to a shuttleless loom.

DESCRIPTION OF THE PREFERRED EMBODIMENT

Referring now to the drawing in which the preferred embodiment of the invention is illustrated, and with reference initially to FIG. 1, it will be seen that a yarn storage feeder 10 is positioned in an operating position with respect to a strand consuming device 12 such as a winder, loom, knitting machine, another feeder, or the like. Feeder 10 may be the same as that described in U.S. Pat. No. 3,776,480 which is incorporated herein by reference. Feeder 10 includes an elongated feeder tube 14 supported at its rear section in a bushing 16 protruding from the rear wall 18 of feeder 10. Feeder tube 14 has a central bore 19 therethrough with the forward end being configured as a flyer as shown in the cited patent. Tube 14 is driven by power means not herein shown but which may be an electric motor, to lay yarn in wraps around a drum or accumulator section 21 of feeder 10. The bore 19 through tube 14 may be in the order of 5/16 of an inch in diameter so that it provides a ready entrance for passage of a strand therein. The strandular material which, for purposes of the present discussion may be 1,000 denier polypropylene tape having a width of approximately 0.100 of an inch and a thickness of 0.002 of an inch is wound onto packages P for over-end delivery therefrom to feeder 10. To illustrate the magazining of a plurality of such strand supply packages, two cylindrical packages of strand are shown in FIGS. 1 and 2 and identified respectively as packages $P^1$ and $P^2$. Let it be assumed that supply package $P^1$ is the active unwinding supply package and package $P^2$ is the reserve supply package. The outer end of supply package $P^1$ follows a general thread line 22. The inner end or "transfer tail" 24 of package $P^1$ is tied to the outer strand end 26 of package $P^2$ to provide a transfer loop T. As the strand on supply package $P^1$ is exhausted the outer end 26 of supply package $P^2$, tied to the transfer tail 24 of package $P^1$, automatically commences to unwind without operator attention, following the thread line generally indicated by the broken line 28 in FIGS. 1 and 2. The advantage of magazining of packages has already been mentioned. To array a plurality of packages for delivery of their supply to feeder 10 in a manner such that, as one supply package exhausts, another one automatically becomes the active winding supply without a requirement for operator attention renders an efficient technique when it is borne in mind that it is rather common for a supply package of tape feeding to a feeder 10 connected to a projectile-type loom weaving carpet backing normally run out in approximately thirty minutes of unwinding, and considering that if operator attention is required to replace that supply package with a fresh supply the consumption of time is in the order of one or two minutes, the total labor for this operation over a work shift for an operator attending a relatively large number of looms is considerable. Coupled with this is lost weaving time. Also, there are inherent disadvantages in causing a loom to stop since interference with the normal weaving cycle can provide recognizable imperfections in the fabric being woven. Therefore, magazining of supply packages delivering strand to feeder 10 affords many advantages. Of course, while only two supply packages $P^1$ and $P^2$ are shown as magazined herein, any number of packages of supply strand can be magazined for sequential delivery of the strand thereon.

It will be appreciated that in the overend unwinding of plastic tape from a cylindrical package each wrap of yarn delivered from the cylindrical package to a fixed point will introduce a turn of twist into the tape. If this tape, so twisted, is pulled over a stationary guide, fibrillation or splitting of the tape can occur or be induced for the reasons discussed earlier. This split tape eventually forms a pick introduced through the shed of the loom 12 for beat up into the fabric, assuming the consumer device to be a loom. The split tape is difficult to manage and presents interferences with the normal weaving cycle of the loom as, for example, when the tape is severed after the introduction of the pick. For instance, the scissors which function to advance at the end of the pick to sever the tape frequently will shear off less than the full strand since the point of the shares enters through the mid-section of split tape cutting only a portion of the strand and leaving the rest of the strand intact. Further, even if the scissors cuts the entirety of the split tape the weft insertion gripper may catch only a few fibrils of the next pick rather than the entire tape end, and cause a mispick. In either event the loom shuts down and costly time and labor are required to correct the malfunction. Therefore it is of importance that the fibrillation or splitting of the tape be precluded to the maximum extent.

To prevent such splitting or fibrillation it has been known heretofor to provide but a single package of supply tape which is carefully aligned with the longitudinal axis of feeder tube 14 so that the tape will enter the bore 19 of the tube without substantial wrapping over any stationary guide means. While this technique has yielded some limited success in avoiding fibrillation of the tape, nevertheless, as has already been pointed out, such a technique inherently leads to frequent stops of the loom while a new supply package is fixed in position upon the exhaustion of an active unwinding supply package. With the present invention magazining of a plurality of packages oriented to deliver their strands therefrom in paths at angles of 90° or more to the longitudinal axis of tube 14 is possible without substantial splitting or fibrillation of the strand.

With continuing reference to the drawing and with particular reference at this point to FIGS. 1, 3 and 4, the rear end 18 of feeder 10 is shrouded by a shield 52 held in place by means of a bracket 54. Viewing FIG. 4 it will be observed that bracket 54 is connected to a U-shaped member 56 by means of a cap screw 58. In turn the opposing end of U-shaped member 56 is connected to shield 52 by means of a further cap screw 60. The opposite end of bracket 54 is affixed to the rear wall 18 of feeder 10 by means of still another cap screw 62. Member 56 is spaced from the rear wall 18 of feeder 10 and serves as a mount for a pair of freely rotating wheels 74 and 76 which are supported on respective stub shafts 78 and 80 embedded in member 56. Each of the stub shafts 78 and 80 is provided with suitable bearings 82 for supporting its associated wheel. The wheels are recessed into enlarged bores in a block 84 which, in turn, is fixed to the member 56, the wheels being spaced from the walls of the recesses within the block 84 for free rotation. The two wheels are so disposed that the point of tangency of the wheels coincides with the axis of bore 19. The wheels are spaced a minimum distance from each other for the admission of a threading tool therebetween to lead the strand S into the bore 19 of tube 18 for threading onto the drum of feeder 10. It will be observed in FIG. 2 that shield 52 has an elongated slot 88 extending transversely thereof in the horizontal plane of wheels 74 and 76 but being of lesser width than the height of said wheels 74 and 76. Shield 52 prevents inadvertent engagement of the strand S with the various parts of feeder 10 as the strand feeds off its supply package P and balloons in its over-end unwinding and advance to the respective one of the wheel 74 or 76 and into tube 14. As the strand moves around either of the respective wheels 74, 76 and into the bore 19 of tube 18 it is caused to flow through a fixed guide 90 positioned intermediate the two wheels 74, 76 and at the downstream end of block 84. Since guide 90 is in the straight-line path of advance of the strand from its guide wheel 74 or 76, relatively free flow of the strand through guide 90 occurs without substantial frictional engagement with said guide.

From the foregoing detailed description the operation of the present invention will be readily evident. To present a brief summary of the operation thereof, packages $P^1$ and $P^2$ of strandular materials such as polypropylene tape are magazined in position to provide strand S to feeder 10 for delivery to the consuming unit 12. The strand S pulled off a first supply package $P^1$ by rotation of tube 14, is delivered over-end and initially flows in a first path at an angle to the axis of bore 19 of feed tube 14. This angle depends upon the location at which package P is situated relative to its related wheel 74 or 76. The guide wheels 74 and 76 which are freely rotatable as the strand is in engagement thereon and pulled thereover, are located about 2 inches upstream from the end 19 of feeder tube 14. Strand S is guided through the elongated slot 88 in shield 52 and wrapped around a portion of the periphery of one of the wheels 74 or 76. Wheels 74 and 76 have a tangent point which resides in the plane of bore 19 of tube 14. Accordingly, the strand after wrapping about a wheel 74 or 76 and passing through strand guide 90 enters bore 19 without introduction of additional tension as the tape advances into feed tube 14. As the strand S wraps about its associated wheel it is caused to shift direction from a first path and move into a second path where the strand moves along a line coaxial with the bore 19 of feeder tube 14. At all times strand S is prevented from over-end movement off its wheel 74 or 76 by horizontal containment within the limits of slot 88.

Unwinding of supply package $P^1$ continues until the strand S thereon is exhausted. Since transfer loop T is provided by attachment of the transfer tail 24 of package $P^1$ to the outer end 26 of strand supply package $P^2$ the strand on package $P^2$ automatically commences to unwind and becomes the active strand supply. The strand on package $P^2$ is controlled by the wheel 76 and the guide slot 88 in a similar manner as the strand feeding off $P^1$. Since both wheels 74 and 76 are freely rotating the twist present in the tape as it is delivered off over-end from its respective package $P^1$ or $P^2$ is permitted to pass around the wheels without interference. The twist in the strand S flows freely and evenly onto drum 21 of feeder 10 and is not restricted by movement over the respective wheels.

While the inlet guide means has thus far been described in the environment of a strand feeder, the present invention can be utilized to control strandular material in conjunction with other equipment. By way of example and with reference to FIG. 5, the numeral 94 designates a loom of the shuttless type. Strand S is drawn off package P following a first path generally at an angle of 90° to the path of movement of the strand through the shed of loom 94. The strand S is caused to wrap partially about wheel 74 and departs from the wheel in a path generally aligned with the path the strand will follow as it is propelled through the loom shed. Here again, the strand is delivered to its user means without splitting or fibrillating due to the fact that tension in the strand downstream of wheel 74 is essentially equal to that in the strand immediately upstream of the wheel regardless of the angle of wrap of strand on the wheel. Magazining is effected in the same manner as the embodiment of FIGS. 1–4.

It will be understood that modifications and variations within the concept described above are possible and will be readily suggested to the skilled worker in the field and such modifications and variations are intended to be within the scope of the invention except when excluded by the limitations of the following claims.

What is claimed is:

1. In combination with a strand storage feeder onto which a predetermined amount of strand is accumulated for delivery to strand consuming means, said feeder being operable to receive advancing strand delivered to a bore of a delivery tube thereon sequentially from first and second strand supplies, the improvement comprising, first and second roller means, means mounting each said roller means for free rotation, said first strand supply being positioned for delivery of a first strand therefrom to said first roller means in a first path, said second strand supply being postioned for delivery of a second strand therefrom to said second roller means in a first path, said first and second strands being engaged with said respective first and second roller means during advance along said respective first paths and directed in a second path diverging from said respective first paths, said first and second roller means being disposed to move said respective first and second strands into generally axial alignment with the bore of said delivery tube as said strands move in said second path, and said first and second roller means rotating as said respective first and second strands are advanced thereover to maintain strand tension in said second path substantially equal to the strand tension in said first path of each of said first and second strands.

2. The combination as set forth in claim 1 including means limiting transverse movement of each said strand on its respective roller means to preclude overend movement of each said strand off said respective roller means.

3. The combination as set forth in claim 2 wherein said first and second roller means each includes a roller having a surface of engagement for one of said advancing strands, each said roller being freely rotatable in response to frictional engagement of an advancing strand with said surface.

4. The combination as set forth in claim 1 wherein said strand consuming means is a loom.

5. The combination as set forth in claim 1 wherein each said strand forms a balloon when withdrawn from its respective supply and advanced along its respective first path, and including shield means for generally isolating said ballooning strand from contact with said feeder.

* * * * *